US009266254B2

(12) United States Patent
Schneider

(10) Patent No.: US 9,266,254 B2
(45) Date of Patent: Feb. 23, 2016

(54) WATER/SLURRY CONTAINMENT DEVICE

(76) Inventor: James Eric Schneider, Tampa, FL (US)

( * ) Notice: Subject to any disclaimer, the term of this patent is extended or adjusted under 35 U.S.C. 154(b) by 630 days.

(21) Appl. No.: 13/526,743

(22) Filed: Jun. 19, 2012

(65) Prior Publication Data

US 2012/0325557 A1 Dec. 27, 2012

Related U.S. Application Data

(60) Provisional application No. 61/501,543, filed on Jun. 27, 2011.

(51) Int. Cl.
*B28D 7/02* (2006.01)
*E21B 21/06* (2006.01)
*E21B 7/00* (2006.01)

(52) U.S. Cl.
CPC ..... *B28D 7/02* (2013.01)

(58) Field of Classification Search
CPC ..... E21B 21/06; E21B 10/58; E21B 10/38; E21B 21/10; E21B 7/00; E21B 21/00; E21B 27/00; B23B 51/044; B23B 2226/75; B23B 47/34; B23B 2270/30; B25D 17/18; Y10T 409/304088; B28D 7/02
USPC ..... 175/57, 417, 418, 419, 420.1; 408/67; 173/217, 197
See application file for complete search history.

(56) References Cited

U.S. PATENT DOCUMENTS 3,351,143 A * 11/1967 Seibold et al. ..... 175/209
3,837,412 A 9/1974 Driver
3,958,521 A 5/1976 Memoli
4,071,099 A 1/1978 Hensel, Jr.
4,312,414 A 1/1982 Park
4,353,719 A 10/1982 Kennedy, Jr.
4,355,826 A 10/1982 Von Braun
4,412,501 A 11/1983 Davis
4,457,627 A 7/1984 Kirby et al.
4,460,292 A 7/1984 Durham et al.
4,592,846 A 6/1986 Metzger et al.
4,630,681 A 12/1986 Iwamoto
4,711,609 A 12/1987 Seefluth
4,848,487 A 7/1989 Anderson et al.
4,911,253 A 3/1990 Cliche
4,930,577 A 6/1990 Grantom
4,949,797 A 8/1990 Isom
4,997,048 A 3/1991 Isom
5,097,976 A 3/1992 Zink et al.
5,114,273 A 5/1992 Anderson
5,211,202 A 5/1993 Zink et al.
5,490,419 A 2/1996 Webb
5,660,240 A 8/1997 Harms et al.
5,957,624 A 9/1999 Carter, Jr. et al.
6,132,147 A 10/2000 Kazirskis
6,796,381 B2 9/2004 Ayler et al.
(Continued)

*Primary Examiner* — Blake Michener
*Assistant Examiner* — Wei Wang

(57) ABSTRACT

A water/slurry containment device for core drilling can contain and allow water/slurry to be extracted while the coring is occurring rather than allowing a puddle to form with more extensive cleanup required afterward. The device contains the water/slurry mix so that none escapes the confines of the device, so that water can be used in the core drilling. Water is essential to the life of the diamond coated bit and it keeps dust and noise to a minimum. The device includes a base plate with a collector ring that can rest on a surface to be core drilled. A notch can be cut in the collector ring and/or base plate to allow water and slurry to be removed from the device while core drilling.

5 Claims, 2 Drawing Sheets

(56) References Cited

U.S. PATENT DOCUMENTS

| | | | | |
|---|---|---|---|---|
| 6,830,113 | B2 * | 12/2004 | Moore et al. | 173/198 |
| 7,621,352 | B2 | 11/2009 | Izatt | |
| 7,726,417 | B2 | 6/2010 | Larsson | |
| 7,901,164 | B2 * | 3/2011 | Skradski et al. | 408/67 |
| 2002/0114677 | A1 | 8/2002 | Ishikawa | |
| 2007/0172337 | A1 | 7/2007 | Browne et al. | |
| 2010/0101789 | A1 | 4/2010 | Dickinson, III et al. | |
| 2010/0197211 | A1 | 8/2010 | Guth | |
| 2010/0200216 | A1 | 8/2010 | Webb | |

* cited by examiner

WATER/SLURRY CONTAINMENT DEVICE

CROSS-REFERENCE TO RELATED APPLICATIONS

This application claims the benefit of priority of U.S. provisional patent application No. 61/501,543 filed Jun. 27, 2011, the contents of which are herein incorporated by reference.

BACKGROUND OF THE INVENTION

The present invention relates to core drilling accessories and, more particularly, to a water/slurry collection device used for core drilling.

Currently, either a clay mixture is used to build a dam around each hole before drilling, which is extremely labor intensive, or there are some plastic or rubber collars that are very light, and tend to wear out or get abused in the construction environment. Typically, many use a pump-up sprayer which usually holds no more than one or two gallons of water and the water is sprayed on the outside of the bit, which does not assure that the diamonds are properly cooled. A typical core drill rig has a flow through collar whereby the water is injected directly through the hollow bit to the work.

The resulting slurry creates a wet, slick area on the surface being core drilled. After the drilling, much time and effort are required to clean up the area. Occasionally, people have had slip and fall injuries due to the slurry being left or unattended. Damage has been done to adjacent surfaces due to the slurry not being controlled.

Existing systems are too light, time consuming, complicated, wear out too easily, or are too expensive. By having a fresh flow of water, the bit is kept free of the products of coring which often includes metal particles from rebar or reinforcing wire which, if not continuously flushed from the cut, puts needless wear on the bit and can overload or overheat the drill motor.

As can be seen, there is a need for a core drilling accessory that can contain and extract water/slurry while coring is occurring rather than allowing a puddle to form with more extensive cleanup required afterward.

SUMMARY OF THE INVENTION

In one aspect of the present invention, a collection and containment device comprises a base plate disposed in a flattened donut shape having an inside opening, the base plate adapted to fit around a location where a core is to be drilled; a collector ring extending from a first side of the base plate, the collector ring having an inside diameter aligned with the inside opening of the base plate; a gasket disposed on a second, opposite side of the base plate; and an opening formed in at least one of the base plate and the collector ring providing a connection between an inside of the device and an outside of the device.

In another aspect of the present invention, a collection and containment device comprises a base plate disposed in a flattened donut shape having an inside opening, the base plate adapted to fit around a location where a core is to be drilled; a collector ring extending from a first side of the base plate, the collector ring having an inside diameter aligned with the inside opening of the base plate; a gasket disposed on a second, opposite side of the base plate; an opening formed in at least one of the base plate and the collector ring providing a connection between an inside of the device and an outside of the device; a vacuum attachment sleeve covering and extending from the opening; and a base plate notch formed in the base plate and a collector ring notch formed in the collector ring, the base plate notch and the collector ring notch aligned to form the opening.

In a further aspect of the present invention, a method for containing and extracting water/slurry during core drilling comprises disposing a gasket attached to a base plate against a surface to be core drilled, the base plate disposed in a flattened donut shape having an inside opening, the base plate adapted to fit around a location where a core is to be drilled, the base plate having a collector ring extending from a first side of the base plate, the collector ring having an inside diameter aligned with the inside opening of the base plate; attaching a vacuum to a vacuum attachment sleeve that communicates to an inside of the collector ring; applying water to the inside of the collector ring while core drilling; and removing water/slurry from the inside of the collector ring while core drilling.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a water/slurry containment device for core drilling that can contain and allow water/slurry to be extracted while the coring is occurring rather than allowing a puddle to form with more extensive cleanup required afterward. The device contains the water/slurry mix so that none escapes the confines of the device, so that water can be used in the core drilling. Water is essential to the life of the diamond coated bit and it keeps dust and noise to a minimum. The device includes a base plate with a collector ring that can rest on a surface to be core drilled. A notch can be cut in the collector ring and/or base plate to allow water and slurry to be removed from the device while core drilling.

Figure 1:
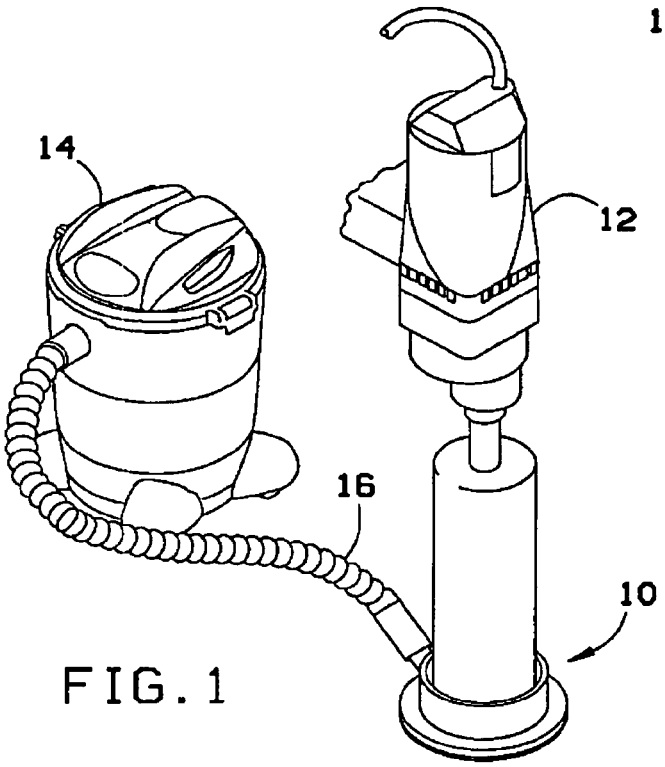
FIG. 1 is a perspective view of a containment and extraction device, in use, according to an exemplary embodiment of the present invention.
Figure 2:
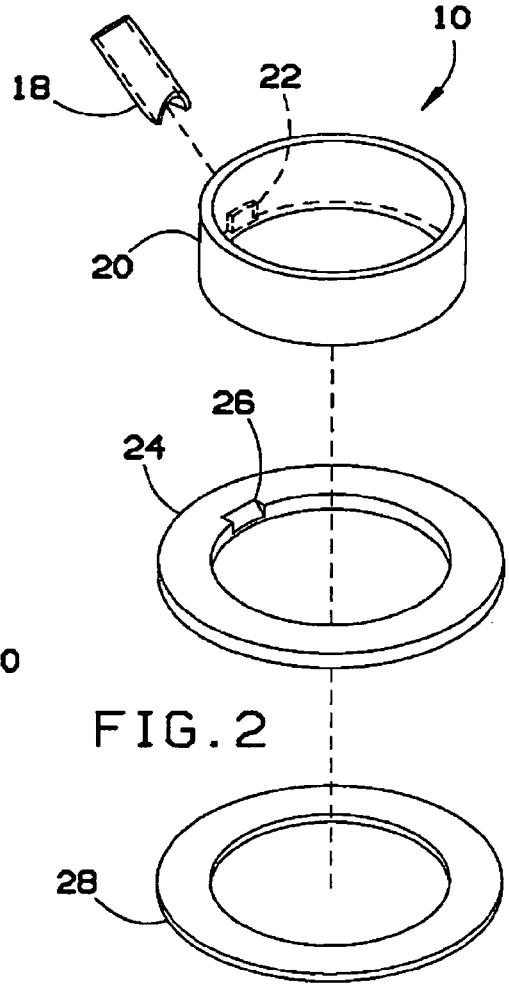
FIG. 2 is an exploded perspective view of the containment and extraction device of FIG. 1.
Figure 3:
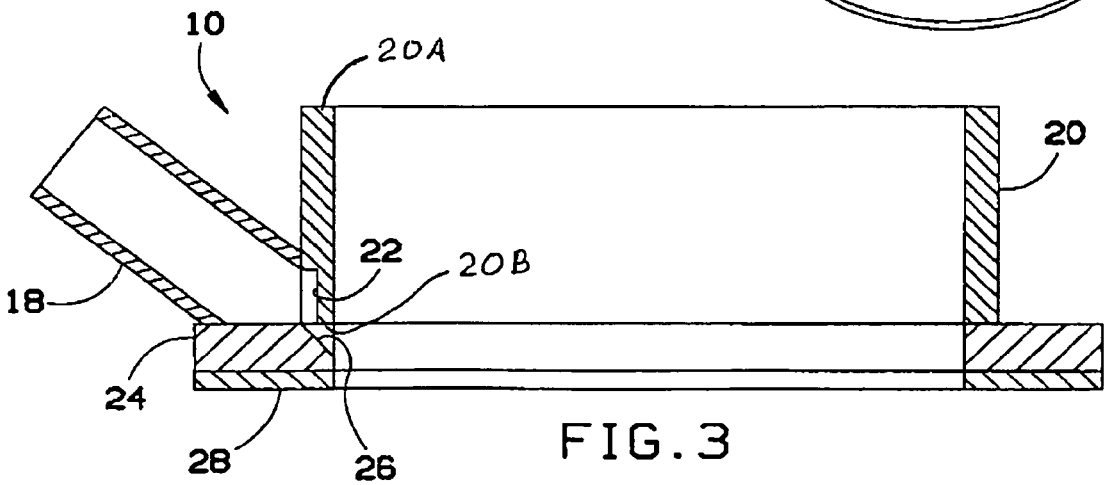
FIG. 3 is a cross-sectional view of the containment and extraction device of FIG. 1.
Figure 4:
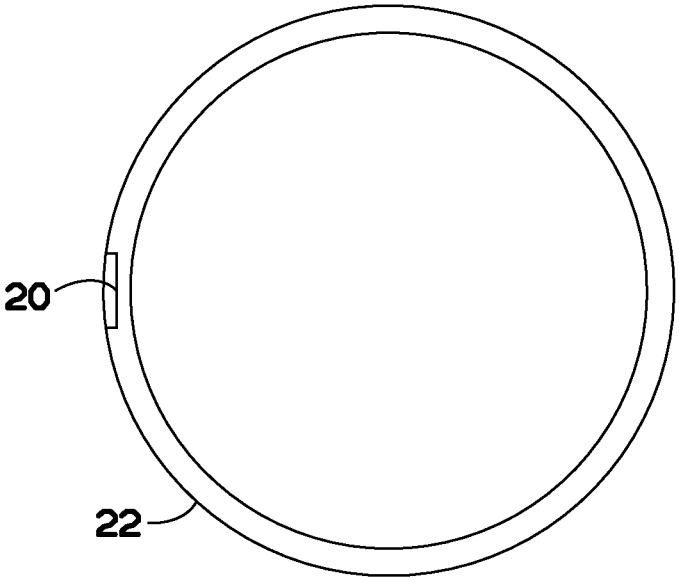
FIG. 4 is a bottom view of a collector ring of the containment and extraction device of FIG. 1.
Figure 5:
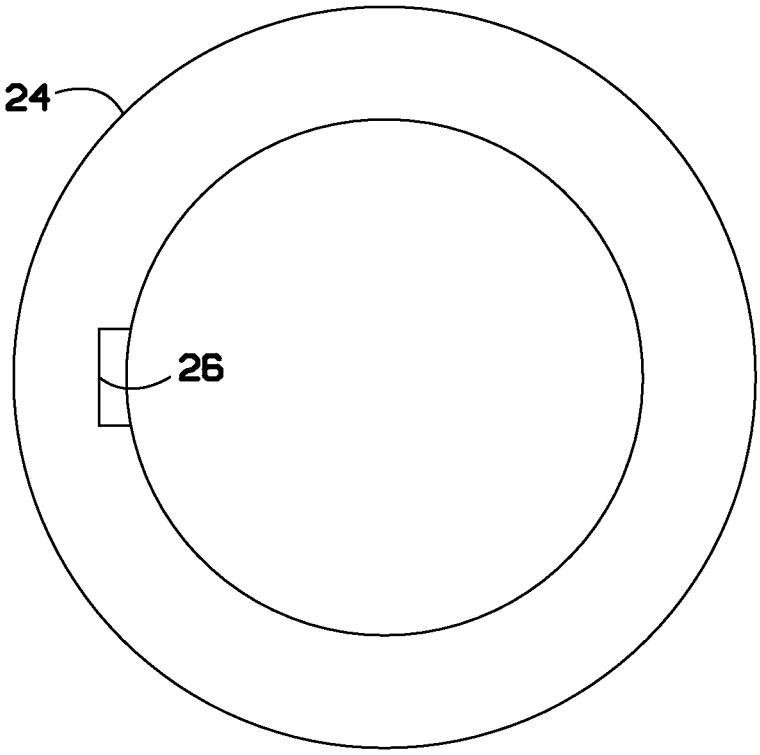
FIG. 5 is a top view of a base plate of the containment and extraction device of FIG. 1.

Referring to FIGS. 1 through 5, a containment and extraction device 10 (also referred to as device 10) can be used with a core drill 12, a vacuum 14 and a vacuum hose 16 to contain and extract water/slurry while core drilling. The device 10 may include a base plate 24, formed in a flattened donut shape, having a central opening having a diameter at least equal to, but typically larger than, the size of a bit in the core drill 12. A gasket 28, such as a foam rubber gasket, can be disposed on a bottom side of the base plate 24. The gasket 28 may be used to provide a seal between the base plate 24 and the surface being drilled. The base plate 24 offers stability to the device 10, a wider area for the gasket 28 to contain water, and weight to help keep the gasket 28 tight against the surface, especially when the surface is rough or uneven. The base plate 24 can have a width (width being defined as the distance from an inner periphery to the outer periphery of the flattened donut shape) from about ¼ inch to about 4 inches, for example. In some embodiments, the base plate 24 has a width greater than a thickness of the collector ring 20.

A collector ring 20 may be disposed on a top side of the base plate 24. The collector ring 20 may be an open tubular member from about 2 to about 5 inches long, typically about 3 inches long extending between a top end 20A and a bottom end 20B. The collector ring 20 may have a diameter that is the same as the diameter of the opening in the base plate 24. In some embodiments, the collector ring 20 may be attached to the base plate 24 by various methods, such as welding, adhesive, or the like. In some embodiments, 10 the collector ring 20 may be formed integrally with the base plate 24.

The collector ring 20 can be made from various materials, such as plastic, metal, composite, or the like. In some embodiments, the collector ring 20 can be made of Schedule 40 pipe of various diameters depending on the need for a particular job or client. The smaller diameters can include 3-inch and 4-inch inside diameter pipe sleeves by about 3 inches high. The most common sizes will be 6-inch, 8-inch, 10-inch and 12-inch inside diameter pipe sleeves. Other larger sizes can be custom made to order, should a client need them. These sizes usually use no more than 3-inch high sleeves, as these will usually be sufficient to extract the fresh flow of water from the drill 12 with a wet/dry shop vacuum 14. Higher collector rings 20 can be supplied custom made should an application require it. Lighter wall collector rings 20 could also be used, but the standard wall Schedule 40 are typically used as they are most readily available, add the desired weight to help with the gasket 28, and can withstand the rigors of the construction environment.

A collector ring notch 22 may be formed on an outside surface of the collector ring 20. A base plate notch 26 may be disposed in an inside surface of the base plate 24. The collector ring notch 22 and the base plate notch 26 may align to provide a path from outside the device 10 to inside the device 10.

A vacuum attachment sleeve 18 may be attached to the collector ring 20 and the base plate 24. The vacuum attachment sleeve 18 may provide a flow path from inside/outside the device 10 via the collector ring notch 22 and the base plate notch 26. The vacuum attachment sleeve 18 may be from about 2 to about 5 inches long, typically about 3¾ inches long. The vacuum attachment sleeve 18 may have a diameter to attach to the vacuum hose 16, typically about a 1¼ inch diameter, for example. The vacuum attachment sleeve 18 can be welded to the collector ring 20 and the base plate 24 at an angle from vertical, such at a 40 degree angle, for example, at the intersection of the base plate 24 to the collector ring 20. The vacuum attachment sleeve 18 is compact, not obtrusive or bulky, does not rise above the device 10 itself. This configuration lends itself to packaging that is the most reasonable for shipping as well.

To use the device 10, a drill operator simply needs to mark the hole layout, position the bit for the core, raise the bit to allow the device to be put in place, lower the bit to below the top of the device, turn on the vacuum, water and drill motor, then slowly lower the bit for the cut. After coring to the desired depth, the operator can raise the bit, keeping it within the height of the device, turn off the drill and the water (core drills have a valve at the drill which are turned off without leaving the drill), finish raising the bit above the device, move the drill rig out of the way, whereupon the core plug can be removed with the device still in place. The operator can then remove the vacuum nozzle from the device and use it to vacuum the water from the hole. This can simply be repeated for the next hole. The device of the present invention is very efficient, saves much time trying to clean up a mess when letting the slurry just run on the floor, and saves needless wear on the bits and equipment.

The elements described above could be altered to meet certain needs on different projects. For instance, the vacuum attachment sleeve 18 could be welded at a different angle, the base plate 24 could be offset to get tighter to a wall, and the base plate 24 could have two or more narrower sides to fit in a track. The device 10 could be modified for plumbing contractors, electricians, and the like.

In some embodiments, the base plate 24 can be eliminated (or, the base plate 24 can have a width that is the same as the thickness of the collector ring 20) in the case of tight surroundings, or a need to core closer to a wall or other conditions warranting it. The gasket 28 in such situations can be narrower and have less bearing area and thus may need to be replaced more often, but in a 'have to' situation, the device 10 without the base plate 24 will work well.

It should be understood, of course, that the foregoing relates to exemplary embodiments of the invention and that modifications may be made without departing from the spirit and scope of the invention as set forth in the following claims.

What is claimed is:

1. A collection and containment device for receiving a drilling device, the drilling device creating a core in a surface, the drilling device producing particles from the surface, the collection and containment device, comprising:

a base plate defining a donut shape including a top side and a bottom side for positioning adjacent to the surface;

an inside opening within said base plate defining an inside surface;

a base plate notch in said base plate extending from said inside opening of said base plate to said top side of said base plate;

a collector ring defining a tubular member including an outside surface and an inside diameter;

said collector ring abutting said top side of said base plate;

said inside diameter of said collector ring commensurate with said inside opening of said base plate for aligning said inside opening with said inside diameter and permitting the drilling device to traverse said tubular member and said donut shape to engage the surface;

a collector ring notch in said collector ring extending from said outside surface;

said base plate notch and said collector ring notch aligned for defining a path from said inside opening and said inside diameter to said top side and said outside surface;

a vacuum sleeve coupled to said top side of said base plate and said outside surface of said collector ring and positioned over said path for defining a flow path; and a vacuum engaging said vacuum sleeve for extracting the particles through said path in said base plate and said collector ring and said flow path in said vacuum sleeve.

2. A collection and containment device as set forth in claim 1, further including a gasket positioned between said bottom side of said base plate and the surface for retaining the particles within said base plate and said collector ring.

3. A method for collecting and containing particles from a surface produced by a drilling device, the method, comprising:

positioning a base plate defining a donut shape including, an inside opening, a top side and a bottom side adjacent to the surface;

positioning a base plate notch in said base plate from said inside opening of said base plate to said top side of said base plate;

extending a collector ring, which includes an outside surface and an inside diameter, from said top side of said base plate;

positioning a collector ring notch in said collector ring extending from said outside surface;

aligning said base plate notch with said collector ring notch for defining a path from said inside opening and said inside diameter to said top side and said outside surface;

coupling a vacuum sleeve to said top side of said base plate and said outside surface of said collector ring and over said path for defining a flow path;

inserting a drilling device though said collector ring and said base plate for producing a core in the surface; and attaching a vacuum to said vacuum sleeve for extracting the particles through said path in said base plate and said collector ring and said flow path in said vacuum sleeve.

4. A collection and containment device for receiving a drilling device, the drilling device creating a core in a surface, the drilling device producing particles from the surface, the collection and containment device, comprising:

a base plate defining a donut shape including a top side and a bottom side for positioning adjacent to the surface;

an inside opening within said base plate defining an inside surface;

a base plate notch in said base plate extending from said inside opening of said base plate to said top side of said base plate;

a collector ring defining a tubular member including a top end, a bottom end, an outside surface and an inside diameter;

said bottom end of said collector ring abutting said top side of said base plate;

said inside diameter of said collector ring commensurate with said inside opening of said base plate for aligning said inside opening with said inside diameter and permitting the drilling device to traverse said tubular member and said donut shape to engage the surface;

a collector ring notch in said collector ring extending from said outside surface of said collector ring to said bottom end of said collector ring;

said base plate notch and said collector ring notch aligned for defining a path from said inside opening and said inside diameter to said top side and said outside surface;

a vacuum sleeve coupled to said top side of said base plate and said outside surface of said collector ring and positioned over said path for defining a flow path; and a vacuum engaging said vacuum sleeve for extracting the particles through said path in said base plate and said collector ring and said flow path in said vacuum sleeve.

5. A collection and containment device as set forth in claim 4, further including a gasket positioned between said bottom side of said base plate and the surface for retaining the particles within said base plate and said collector ring.

* * * * *